US007856194B2

(12) United States Patent
Murakami

(10) Patent No.: US 7,856,194 B2
(45) Date of Patent: Dec. 21, 2010

(54) INTERMEDIATE TRANSFER UNIT-MOUNTING AND DISMOUNTING MECHANISM AND INTERMEDIATE TRANSFER UNIT-MOUNTING AND DISMOUNTING METHOD

(75) Inventor: Susumu Murakami, Kizugawa (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 402 days.

(21) Appl. No.: 12/076,590

(22) Filed: Mar. 20, 2008

(65) Prior Publication Data

US 2008/0260423 A1 Oct. 23, 2008

(30) Foreign Application Priority Data

Apr. 17, 2007 (JP) ..... 2007-108322

(51) Int. Cl.
*G03G 15/00* (2006.01)
*G03G 15/14* (2006.01)
*G03G 21/00* (2006.01)

(52) U.S. Cl. ..... 399/121; 399/302; 399/308

(58) Field of Classification Search ..... 399/12, 399/21, 121, 297, 298, 299, 302, 303, 308
See application file for complete search history.

(56) References Cited

U.S. PATENT DOCUMENTS 5,220,386 A * 6/1993 Aoki et al. ..... 399/71
5,966,564 A * 10/1999 Kizaki et al. ..... 399/101
6,889,027 B2 * 5/2005 Tachiki et al. ..... 399/297
7,257,351 B2 * 8/2007 Tachiki et al. ..... 399/121
7,274,897 B2 * 9/2007 Katoh ..... 399/121
7,298,991 B2 * 11/2007 Kimura et al. ..... 399/117
7,379,690 B2 * 5/2008 Ito ..... 399/165
2006/0072929 A1 * 4/2006 Takahashi ..... 399/13

FOREIGN PATENT DOCUMENTS

JP 2000-56658 A 2/2000
JP 2003-249774 A 9/2003
JP 2005-208142 A 8/2005
JP 2006-84842 A 3/2006

* cited by examiner

*Primary Examiner*—David M Gray
*Assistant Examiner*—Fred Braun
(74) *Attorney, Agent, or Firm*—Nixon & Vanderhye, P.C.

(57) ABSTRACT

An intermediate transfer unit mounting and dismounting mechanism for an image forming apparatus including a transfer belt unit that is provided as a separate structure from the apparatus body and can be mounted to and dismounted from the apparatus body, includes: a coupling/decoupling manipulator disposed at the coupling portion between the intermediate transfer unit and the apparatus body for coupling/decoupling. The coupling/decoupling manipulator includes a threaded portion to fasten the intermediate transfer unit and the apparatus body and a drive gear for transferring driving force for conveying the intermediate transfer belt. While the threaded portion is rotated to release the fastening between the transfer belt unit and the housing, the transfer belt is conveyed by the drive gear that rotates in linkage with the rotation of the threaded portion.

11 Claims, 6 Drawing Sheets

INTERMEDIATE TRANSFER UNIT-MOUNTING AND DISMOUNTING MECHANISM AND INTERMEDIATE TRANSFER UNIT-MOUNTING AND DISMOUNTING METHOD

This Nonprovisional application claims priority under 35 U.S.C. §119(a) on Patent Application No. 2007-108322 filed in Japan on 17 Apr. 2007, the entire contents of which are hereby incorporated by reference.

BACKGROUND OF THE INVENTION (1) Field of the Invention

The present invention relates to a mechanism and method of mounting and dismounting an intermediate transfer unit, in particular relating to a mechanism and method of mounting and dismounting an intermediate transfer unit for use in an image forming apparatus, which includes an intermediate transfer unit as a separate unit from the apparatus body that is integrally constructed of an intermediate transfer element to which a toner image formed on a photoreceptor drum is temporarily transferred and a drive portion for driving the intermediate transfer element, and in which the intermediate transfer unit is constructed so that it can be mounted to and dismounted from the apparatus body.

(2) Description of the Prior Art

Conventionally, in the field of image forming apparatuses such as printers, facsimile machines and the like, there have been known image forming apparatuses which adopt a so-called intermediate transfer system in which the toner formed on the photoreceptor drum is temporarily transferred (in the primary transfer) to an intermediate transfer element (e.g., transfer belt) and the toner image is then transferred from the intermediate transfer element to a recording medium (in the secondary transfer). As such image forming apparatus using this system, there has been known a configuration in which a transfer belt as the intermediate transfer element and a driver or the like that drives the belt are integrated into a unit so as to improve assembly and maintenance performance.

However, in this configuration, if a paper feed jam or the like occurs inside the intermediate transfer unit, the toner image remnant of the final image may remain on the transfer belt, so that it is not preferable from a security viewpoint if the intermediate transfer unit is simply drawn out.

In particular, in a case of a configuration where the belt conveyor path in the intermediate transfer unit is arranged with a transfer cleaner for cleaning the transfer belt disposed at its one end and the transfer station for the secondary transfer disposed at the other end or on the opposite side, the toner image remnant after the secondary transfer is left on the transfer belt in the section from the secondary transfer station to the transfer cleaner, making the problem outstanding.

Further, if the intermediate transfer unit with toner image remnant and other remaining toner residing on the transfer belt is drawn out to perform maintenance of the apparatus body and intermediate transfer unit, there is the problem that the remaining toner is prone to make dirty.

As a countermeasure against dirty due to remaining toner in the prior art, there is a proposal of a color image forming apparatus configuration using an intermediate transfer belt system with which cleaning performance is improved by creating a toner dam by supplying supplemental toner for cleaning to the press-contact area of the cleaning blade so as to prevent the toner from slipping through the cleaning blade (see patent document 1: Japanese Patent Application Laid-open 2006-84842).

In the above conventional technique, it is possible to improve cleaning performance for the image support by applying supplemental toner for cleaning to the image support, however, among the above conventional problems the technique does not bring any solution to the security problem of the toner image remnant being left on the transfer belt when the intermediate transfer unit is drawn out.

SUMMARY OF THE INVENTION

The present invention has been devised in view of the above conventional problems, it is therefore an object of the present invention to provide a mechanism and method of mounting and dismounting an intermediate transfer unit for use in an image forming apparatus using an intermediate transfer system, which can improve security against a leakage of printed data when the intermediate transfer unit is dismounted and which can prevent the remaining toner on intermediate transfer element from dirtying the apparatus.

The mechanism and method of mounting and dismounting an intermediate transfer unit according to the present invention in order to achieve the above object are configured as follows:

In accordance with the first aspect of the present invention, an intermediate transfer unit mounting and dismounting mechanism for use in an image forming apparatus is characterized in that the image forming apparatus comprises: an image forming portion having a photoreceptor drum on which a toner image is formed; an intermediate transfer element to which the toner image formed on the photoreceptor drum is temporarily transferred; a transfer device for transferring the toner image from the intermediate transfer element to a recording medium; a cleaning portion for removing the toner that has not been transferred from the intermediate transfer element to the recording medium by the transfer device and remains on the intermediate transfer element; and an intermediate transfer unit, at least including the intermediate transfer element and a driver for driving the intermediate transfer element as an integrated configuration separated from the apparatus body, and being constructed to be mountable to and dismountable from the apparatus body, the intermediate transfer unit mounting and dismounting mechanism includes: a coupling/decoupling manipulator disposed at the coupling portion between the intermediate transfer unit and the apparatus body for coupling/decoupling the intermediate transfer unit and the apparatus body, the coupling/decoupling manipulator includes: a threaded portion for coupling the intermediate transfer unit and the apparatus body by screw fastening and a gear element for transferring driving force for conveying the intermediate transfer element, and provides the function of screw-fastening the intermediate transfer unit and the apparatus body by rotating the threaded portion in a predetermined direction and the function of disengaging the fastened condition between the intermediate transfer unit and the apparatus body by rotating the threaded portion in the direction opposite to the predetermined direction and conveying the intermediate transfer element as the gear element rotates in linkage with the rotation of the threaded portion.

In the present invention, it is preferred that the threaded portion and the gear element are arranged on the same axis. However, it is not essential that they are arranged on the same axis.

The intermediate transfer unit mounting and dismounting mechanism according to the second aspect of the present invention is characterized in that, in addition to the configuration described in the above first aspect, when the coupling/decoupling manipulator is rotated in a direction that releases the fastened condition between the intermediate transfer unit and the apparatus body, the intermediate transfer element is conveyed in the forward direction.

In the present invention, the forward direction of conveyance indicates the direction in which the intermediate transfer element is conveyed in the usual printing operation.

The intermediate transfer unit mounting and dismounting mechanism according to the third aspect of the present invention is characterized in that, in addition to the configuration described in the above first or second aspect, the threaded portion has the function of positioning the intermediate transfer unit relative to the apparatus body.

The intermediate transfer unit mounting and dismounting mechanism according to the fourth aspect of the present invention is characterized in that, in addition to the configuration described in any one of the above first to third aspects, the coupling/decoupling manipulator is disposed on the cleaning portion side.

The intermediate transfer unit mounting and dismounting mechanism according to the fifth aspect of the present invention is characterized in that, in addition to the configuration described in any one of the above first to fourth aspects, the gear portion is arranged in the coupling/decoupling manipulator with a one-way clutch therebetween, and the one-way clutch is arranged so as to transfer drive power when the coupling/decoupling manipulator is rotated in a direction that releases the coupling between the intermediate transfer unit and the apparatus body.

The intermediate transfer unit mounting and dismounting mechanism according to the sixth aspect of the present invention is characterized in that, in addition to the configuration described in any one of the above first to fifth aspects, the intermediate transfer element is formed of an endless belt member.

In the present invention, the intermediate transfer element may have a cylindrical configuration as long as it forms an endless belt member. That is, it is possible to develop a configuration in which cylindrical drum-like member is used as the intermediate transfer element.

The intermediate transfer unit mounting and dismounting mechanism according to the seventh aspect of the present invention is characterized in that, in addition to the configuration described in the above sixth aspect, the coupling/decoupling manipulator is set up so as to be rotatable with a rotational torque of 0.9807 N·m (10 Kgf·cm) or below when the intermediate transfer element is moved.

The intermediate transfer unit mounting and dismounting mechanism according to the eighth aspect of the present invention is characterized in that, in addition to the configuration described in the above sixth or seventh aspect, the intermediate transfer element is formed of chloroprene rubber.

The intermediate transfer unit mounting and dismounting mechanism according to the ninth aspect of the present invention is characterized in that, in addition to the configuration described in any one of the above first to eighth aspects, the coupling/decoupling manipulator operates such that while the threaded portion disengages the coupled condition between the intermediate transfer unit and the apparatus body, the gear element conveys the intermediate transfer element from the position where a releasing operation of the toner image printed just before the releasing operation is started by the coupling/decoupling manipulator, to the position where the toner image passes through the cleaning portion.

Finally, in accordance with the tenth aspect of the present invention, an intermediate transfer unit mounting and dismounting method for use in an image forming apparatus that includes: an image forming portion having a photoreceptor drum on which a toner image is formed; an intermediate transfer element to which the toner image formed on the photoreceptor drum is temporarily transferred; a transfer device for transferring the toner image from the intermediate transfer element to a recording medium; a cleaning portion for removing the toner that has not been transferred from the intermediate transfer element to the recording medium by the transfer device and remains on the intermediate transfer element; and an intermediate transfer unit, at least including the intermediate transfer element and a driver for driving the intermediate transfer element as an integrated configuration separated from the apparatus body, and being constructed to be mountable to and dismountable from the apparatus body, comprises the steps of: screw-fastening the intermediate transfer unit and the apparatus body by rotating a coupling/decoupling manipulator that is disposed at the coupling portion between the intermediate transfer unit and the apparatus body in a predetermined direction of rotation when the fastened condition between the intermediate transfer unit and the apparatus body is engaged; and, releasing the fastened condition between the intermediate transfer unit and the apparatus body by rotating the coupling/decoupling manipulator in the direction opposite to the predetermined direction of rotation and the apparatus and conveying the intermediate transfer element when the fastened condition between the intermediate transfer unit and the apparatus body is engaged.

According to the first aspect of the invention, it is possible to take out the intermediate transfer unit from the apparatus body after the toner image or toner image remnant formed on the intermediate transfer element has been moved by rotating the coupling/decoupling manipulator. Since this rotating operation of the coupling/decoupling manipulator moves the toner image or toner image remnant formed on the intermediate transfer element to the position where it cannot be viewed, it is possible to avoid exposure of the toner image or toner image remnant formed on the intermediate transfer element to other people, hence achieve improvement in security.

Further, since the intermediate transfer element is adapted to pass through the cleaning portion while it is moved, the toner image or toner image remnant on the intermediate transfer element can be cleaned. As a result, it is possible not only to further improve security but also solve the problem of the toner image or toner image remnant on the intermediate transfer element dirtying the apparatus interior.

According to the second aspect of the invention, in addition to the effect obtained by the first aspect of the invention, since the intermediate transfer element is adapted to be conveyed in the forward direction, it is possible to easily convey the intermediate transfer element without hindering the functions in the normal operation of the individual components such as the cleaning portion and the like.

According to the third aspect of the invention, in addition to the effect obtained by the second aspect of the invention, since the intermediate transfer unit is fixed to the apparatus body by rotation of the threaded portion of the coupling/decoupling manipulator and since the fixture is done by the attachment of the coupling/decoupling manipulator itself, it is possible to suppress the variation of the attachment state of the intermediate transfer unit to the apparatus body.

According to the fourth aspect of the invention, in addition to the effect obtained by any one of the first to third aspects of the invention, disposition of the coupling/decoupling manipulator on the cleaning portion side makes it possible for the operator to confirm that no toner image or toner image remnant on the intermediate transfer element resides on the upper surface of the intermediate transfer element, hence it is possible to achieve further improvement in security.

According to the fifth aspect of the invention, in addition to the effect obtained by any one of the first to fourth aspects of the invention, the intermediate transfer unit can be taken out from the apparatus body side (e.g., apparatus frame) easily by the simple structure.

According to the sixth aspect of the invention, since the intermediate transfer element is formed of an endless belt member, the following effect can be obtained in addition to the effect obtained by any one of the first to fifth aspects of the invention. That is, in the intermediate transfer unit for a so-called tandem system, the intermediate transfer element accommodated therein is exposed in its flat part to visual observation. Therefore, if a toner image or toner image remnant has been left on the flat surface, there is a risk of the toner image or toner image remnant being seen. This configuration prevents this and gives improved security.

According to the seventh aspect of the invention, in addition to the effect obtained by the sixth aspect of the invention, since the coupling/decoupling manipulator is designed so that it can be rotated with a rotational torque of 10 Kgf·cm (0.9807 N·m) or below when the intermediate transfer element is moved, this configuration enables the operator to feed the intermediate transfer element with a rotational torque as low as being operable by fingers and easily clean the toner image or toner image remnant.

According to the eighth aspect of the invention, in addition to the effect obtained by the sixth or seventh aspect of the invention, use of chloroprene rubber for the intermediate transfer element assures the strength and elasticity, hence it is possible to clean the intermediate transfer element easily by rotation of a knob.

According to the ninth aspect of the invention, in addition to the effect obtained by any one of the first to eighth aspects of the invention, since the toner image or toner image remnant on the intermediate transfer unit is cleaned by the cleaning portion when the intermediate transfer unit is taken out, it is possible not only to further improve security but also solve the problem of the toner image or toner image remnant on the intermediate transfer element dirtying the apparatus interior.

According to the tenth aspect of the invention, it is possible to draw out the intermediate transfer unit from the apparatus body after the toner image or toner image remnant formed on the intermediate transfer element has been moved by rotating the coupling/decoupling manipulator. Since this rotating operation of the coupling/decoupling manipulator moves the toner image or toner image remnant formed on the intermediate transfer element to the position where it cannot be viewed, it is possible to avoid exposure of the toner image or toner image remnant formed on the intermediate transfer element to other people, hence achieve improvement in security.

Further, since the intermediate transfer element is adapted to pass through the cleaning portion when it is moved, the toner image or toner image remnant on the intermediate transfer element can be cleaned. As a result, it is possible not only to further improve security but also solve the problem of the toner image or toner image remnant on the intermediate transfer element dirtying the apparatus interior.

DESCRIPTION OF THE PREFERRED EMBODIMENTS

The best mode for carrying out the present invention will hereinbelow described with reference to the drawings.

Figure 1:
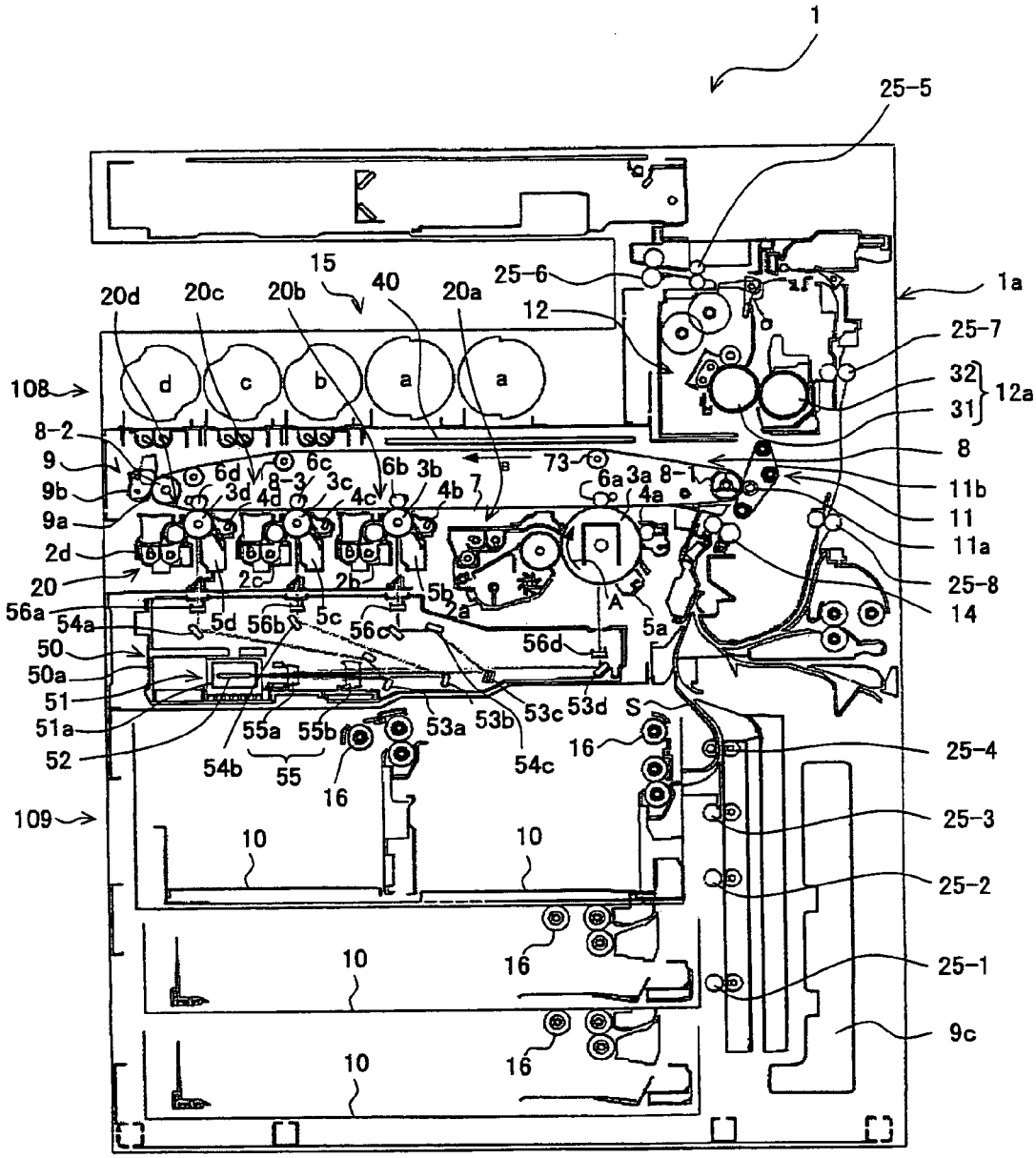
FIG. 1 is an illustrative view showing an overall configuration of an image forming apparatus according to the embodiment of the present invention.
Figure 2:
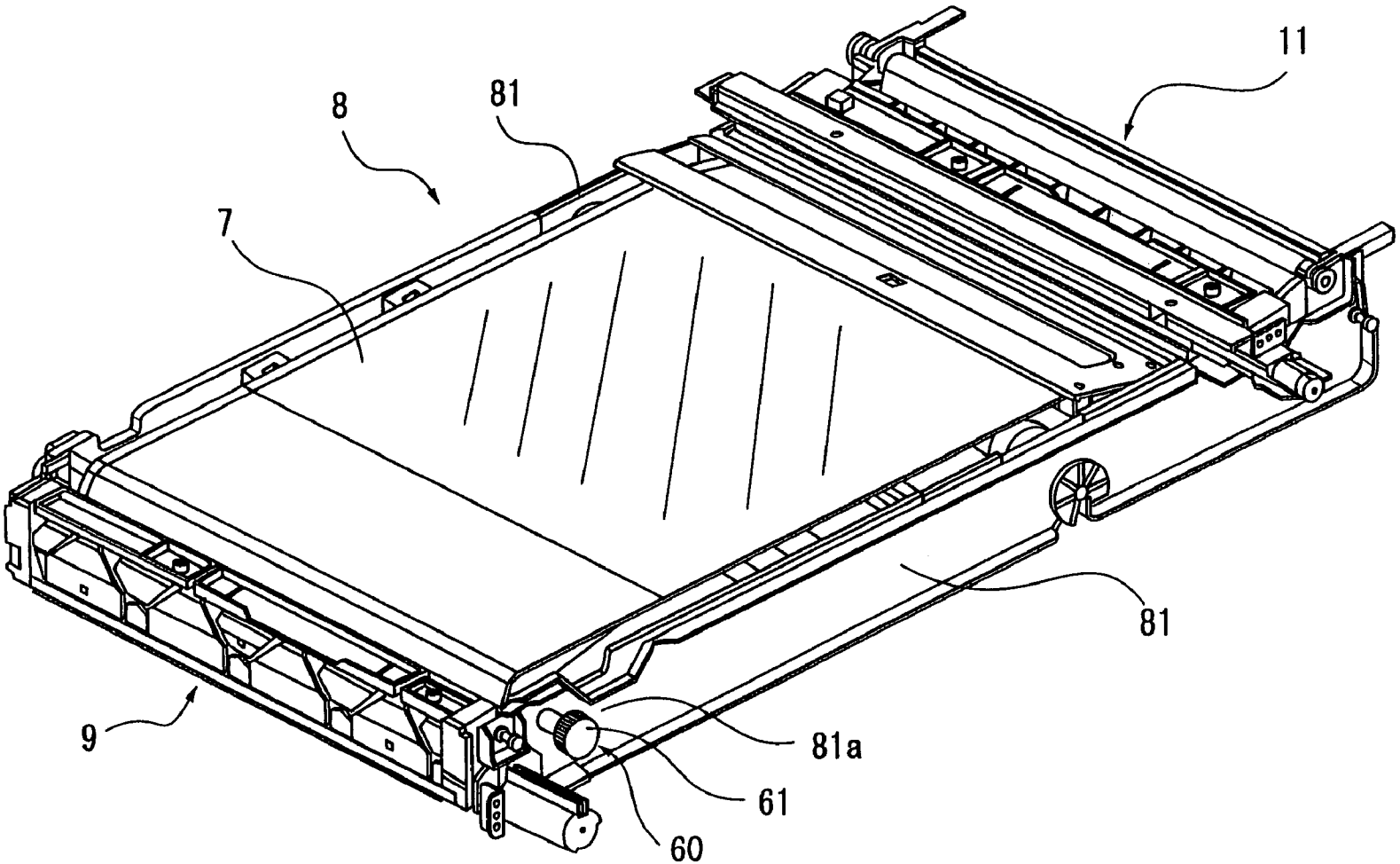
FIG. 2 is an illustrative view showing a configuration of a transfer belt unit as a part of the image forming apparatus.
Figure 3:
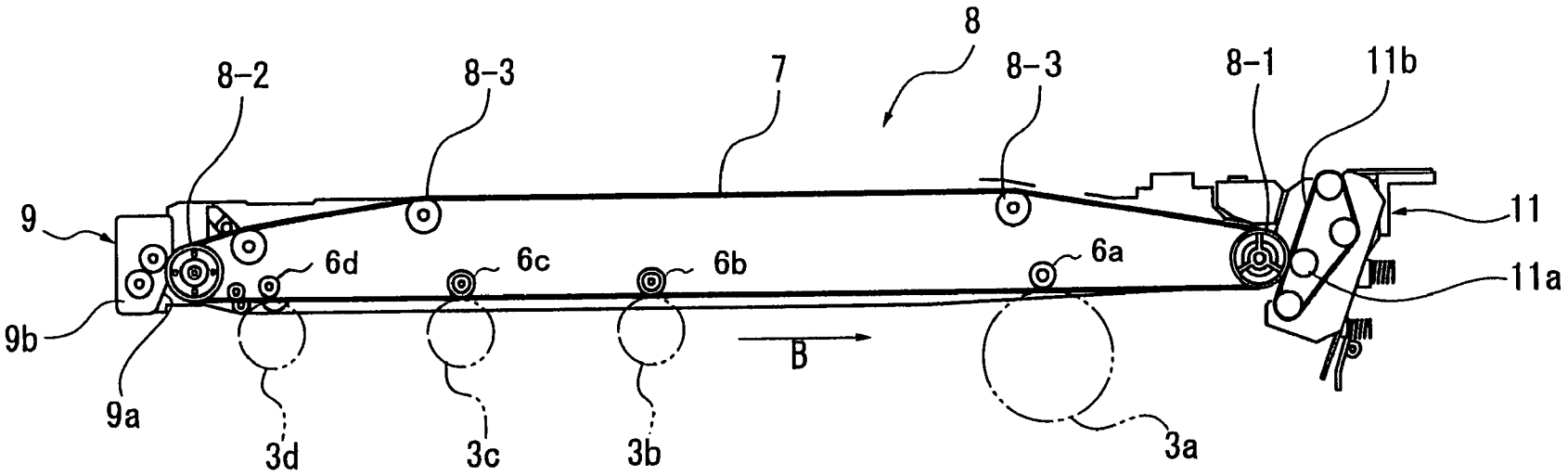
FIG. 3 is a sectional side view showing a configuration of the transfer belt unit.

FIG. 1 shows one example of the mode for carrying out the present invention and is an illustrative view showing an overall configuration of an image forming apparatus according to the embodiment of the present invention; FIG. 2 is an illustrative view showing a configuration of a transfer belt unit as a part of the image forming apparatus; and FIG. 3 is a sectional side view showing a configuration of the transfer belt unit.

As shown in FIG. 1, an image forming apparatus 1 according to the present embodiment includes: a plurality of process printing units 20 (20*a*, 20*b*, 20*c* and 20*d*) for the image forming portion, each having a photoreceptor drum 3 (3*a*, 3*b*, 3*c* or 3*d*) on which a developer image (which will be referred to as "toner image" hereinbelow) is formed with a developer (which will be referred to as "toner" hereinbelow) corresponding to the color of color-separated image information; an endless intermediate transfer belt (intermediate transfer element) 7 for temporarily retaining the toner images formed on photoreceptor drums 3 and transferred therefrom, in a layered manner; a transfer station (transfer device) 11 for transferring the toner image from intermediate transfer belt 7 to recording paper; a fixing unit 12 for thermally fixing the toner image transferred to recording paper; and a transfer belt cleaning unit (cleaning portion) 9 for cleaning intermediate transfer belt 7 of the leftover toner that has not been transferred from intermediate transfer belt 7 to recording paper and remains thereon.

In this configuration, at least intermediate transfer belt 7 and a driver for driving the intermediate transfer belt 7 are integrally constructed into a transfer belt unit (intermediate transfer unit) 8 that is separated from the apparatus body and can be mounted to and dismounted from the apparatus body.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording sheets in accordance with a print job sent from an information processor (not illustrated) such as a personal computer etc., externally connected. Here, as the recording sheets, other than paper, resin sheets, metal sheets and the like can be used as necessary.

Image forming portion 108 forms multi-color images based on electrophotography with yellow (Y), cyan (C), magenta (M) and black (BK) colors. This image forming portion is mainly composed of an exposure unit 50, process printing units 20, fixing unit 12, a transfer belt unit 8 as a transfer portion having intermediate transfer belt 7, intermediate transfer rollers (6*a*, 6*b*, 6*c* and 6*d*) and a transfer belt cleaning unit 9.

In image forming portion 108, fixing unit 12 is disposed on the top at one end side of a housing 1*a* of image forming apparatus 1, transfer belt unit 8 is extended under the fixing unit 12 from one end side to the other end side of housing 1*a*, process printing units 20 are disposed under the transfer belt unit 8, and exposure unit 50 is disposed under the process printing units 20.

Further, transfer belt cleaning unit 9 is arranged on the other end side of transfer belt unit 8. Also, a paper output tray 15 is arranged contiguous to fixing unit 12, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), magenta (M), cyan (C), and yellow (Y) are arranged sequentially along intermediate transfer belt 7. This order of color arrangement realizes the layered toner images on intermediate transfer belt 7 free from color blurring.

Process printing unit 20*d* to which the toner image among the toner images to be transferred onto intermediate transfer belt 7 is transferred first, in other words, process printing unit 20*d* which is arranged at the most distant position from transfer station 11 holds a toner of yellow color and forms yellow toner image first on intermediate transfer belt 7.

These process printing units 20*a*, 20*b*, 20*c* and 20*d* are arranged in parallel to each other, in the approximately horizontal direction (in the left-to-right direction in the drawing) in housing 1*a*, and include respective photoreceptor drums 3*a*, 3*b*, 3*c* and 3*d* as the image support for each individual associated color, respective chargers (charging portions) 5*a*, 5*b*, 5*c* and 5*d* for charging the photoreceptor drums 3*a*, 3*b*, 3*c* and 3*d*, respective developing units (developing portions) 2*a*, 2*b*, 2*c* and 2*d* and respective cleaner units 4*a*, 4*b*, 4*c* and 4*d* and other components.

Here, the symbols a, b, c, and d added to the constituents for individual colors show correspondence to black (BK), magenta (M), cyan (C), and yellow (Y), respectively. In the description hereinbelow, however, the constituents provided for each color are generally referred to as photoreceptor drum 3, charger 5, developing unit 2, and cleaner unit 4, except in the case where the constituents corresponding to a specific color need to be specified and described.

Photoreceptor drum 3 is arranged so that part of its outer peripheral surface comes into contact with the surface of intermediate transfer belt 7 while charger 5 as an electric field generator, developing unit 2 and cleaner unit 4 are arranged along, and close to, the outer peripheral surface of the drum.

As charger 5, a roller type charger is used and arranged at a position on the approximately opposite side across photoreceptor drum 3, from transfer belt unit 8 and close to the outer peripheral surface of photoreceptor drum 3. Though in the present embodiment a roller type charger is used as charger 5, other chargers can be used in place of the roller type charger, such as a brush type charger, corona-discharger type charger.

Exposure unit 50 has a function of creating electrostatic latent images on the surfaces of photoreceptor drums 3 by irradiating each photoreceptor drum 3 whose surface has been electrified at an uniform potential by charger 5, with laser beam in accordance with the image data of each color for printing.

Exposure unit 50 is an optical scan device that is mainly composed of a laser scanning unit (LSU) 51 having a laser illuminator 51*a* incorporated therein, a polygon mirror 52, reflection mirrors 53*a*, 53*b*, 53*c*, 53*d*, 54*a*, 54*b* and 54*c* for reflecting the laser beams for associated colors and other components and emits the laser light emitted from laser illuminator 51*a* to multiple photoreceptor drums 3*a*, 3*b*, 3*c* and 3*d*.

In the bottom of a housing 50*a*, laser scanning unit 51 is arranged at one end side, and polygon mirror 52 and an f-θ lens 55, reflection mirrors 53*a*, 53*b*, 53*c* and 35*d* are arranged in the order mentioned from the aforementioned end side to the other.

Here, concerning laser scanning unit 51, a writing head made up of an array of light emitting devices such as EL (electro luminescence), LED (light emitting diode) and others, may be used instead of laser illuminator 51*a*.

F-θ lens 55 is composed of two lenses, for example, a cylinder lens 55*a* as the first lens and a toroidal lens 55*b* as the second lens.

On the top of housing 50*a*, elongated openings that open along the axial directions of photoreceptor drums are formed opposing photoreceptor drums 3*a*,. 3*b*, 3*c* and 3*d*. Arranged in these openings are respective condenser lenses 56*a*, 56*b*, 56*c* and 56*d* that focus the laser beams reflected from reflection mirrors 53*d*, 54*a*, 54*b* and 54*c*, onto photoreceptor drums 3*a*, 3*b*, 3*c* and 3*d*, respectively.

Developing unit 2 is a device that supplies the color toner, black (BK), magenta (M), cyan (C) or yellow (Y), to the electrostatic latent image formed on the outer peripheral surface of photoreceptor drum 3 by the aforementioned exposure unit 50 to visualize it.

Developing units 2 hold associated toners of black (BK), magenta (M)m cyan (C) and yellow (Y)colors, all being arranged on the downstream side of charger 5 with respect to the rotational direction of the photoreceptor drum (in the direction of arrow A in the drawing). These developing units are constructed so as to supply individual color toners to the electrostatic images formed on the outer peripheral surfaces of the photoreceptor drums 3 and visualize them.

Cleaner unit 4 removes and collects the remaining toner from the surface of photoreceptor drum 3 after transfer of the toner image on the photoreceptor drum 3 surface developed by developing unit 2 to intermediate transfer belt 7. This cleaning unit 4 is arranged on the downstream side of intermediate transfer belt 7 and on the upstream of charger 5 with respect to the rotational direction of the photoreceptor drum.

Further, cleaner unit 4 has a cleaning blade and is configured so that the cleaning blade is positioned in abutment with the outer peripheral surface of photoreceptor drum 3 so as to scrape and collect the leftover toner off the photoreceptor drum 3.

As shown in FIGS. 2 and 3, transfer belt unit 8 is constructed separately from the apparatus body so that it can be mounted to and dismounted from the apparatus body. The transfer belt unit is essentially composed of intermediate transfer belt 7, a transfer belt drive roller 8-1, a transfer belt driven roller 8-2, a transfer belt tension mechanism 8-3 and intermediate transfer rollers 6*a*, 6*b*, 6*c* and 6*d*.

This transfer belt unit 8 has a function of forming a color toner image (multi-color toner image) on intermediate transfer belt 7 by having the toner image of each color formed on the photoreceptor drum 3, sequentially transferring to itself in a layered manner.

In the following description, any of intermediate transfer rollers 6*a*, 6*b*, 6*c* and 6*d* will be referred to as intermediate transfer roller 6 when general mention is made.

Intermediate transfer belt 7 is formed to be endless using chloroprene rubber.

Here, another configuration of an intermediate transfer belt different from the present embodiment may be formed of an endless film of about 75 μm to 120 μm thick, using polyimide, polycarbonate, thermoplastic elastomer alloy or the like.

Also, intermediate transfer belt 7 is tensioned by transfer belt drive roller 8-1, intermediate transfer belt driven roller 8-2, transfer belt tensioning mechanism 8-3 and intermediate transfer rollers 6 so that its surface is adapted to move in the auxiliary scan direction (in the direction of arrow B in the drawing) by the driving force of the transfer belt drive roller 8-1.

Transfer belt drive roller 8-1 is disposed at one end side of housing 1*a* and drives the intermediate transfer belt 7 by applying a driving force to intermediate transfer belt 7 whilst nipping and pressing the intermediate transfer belt 7 and a recording sheet together between itself and transfer station 11 (transfer roller 11*a*) to convey the recording sheet.

Transfer belt driven roller 8-2 is disposed on the other end side of housing 1*a* so as to suspend and tension the intermediate transfer belt 7 approximately horizontally from the one side to the other end side of housing 1*a*, in cooperation with transfer belt drive roller 8-1.

Intermediate transfer rollers 6 are arranged in the interior space of intermediate transfer belt 7 wound between transfer belt drive roller 8-1 and transfer belt driven roller 8-2 and positioned so as to press the inner surface of intermediate transfer belt 7 and bring its outer peripheral surface into contact with part of the outer peripheral surface of each photoreceptor drum 3, forming a predetermined amount of nip.

Further, each intermediate transfer roller 6 is formed of a metal (e.g., stainless steel) shaft having a diameter of 8 to 10 mm and a conductive elastic material such as EPDM, foamed urethane etc., coated on the outer peripheral surface of the metal shaft.

The thus formed intermediate transfer roller 6 is applied with a high-voltage transfer bias for transferring the toner image formed on photoreceptor drum 3 to intermediate transfer belt 7, i.e., a high voltage of a polarity (+) opposite to the polarity (−) of the electrostatic charge on the toner, so as to apply a uniform high voltage from the elastic material to intermediate transfer belt 7.

In the present embodiment, an intermediate transfer roller in the form of a roller-shaped electrode is used as the constitution for performing intermediate transfer. However, as another configuration a brush-like transfer electrode (transfer brush) may be used so that it is placed in contact with the interior side of intermediate transfer belt 7.

All the developed toner images (electrostatic images) corresponding to the individual colors of photoreceptor drums 3 are layered one over the other on intermediate transfer belt 7, forming the image of information that was input to the apparatus. The thus formed image of information in a layered form is transferred to recording sheet at transfer station 11 which is arranged at the position in contact with intermediate transfer belt 7.

Transfer station 11 forms a transfer portion for transferring the developer image that has been transferred to intermediate transfer belt 7 to the recording sheet and includes transfer roller 11*a*. This transfer roller 11*a* is arranged opposing belt driver roller 8-1 at approximately the level and in parallel thereto and pressing against intermediate transfer belt 7 wound on the transfer belt driver roller 8-1, forming a predetermined nip therewith, by way of transfer belt 11*b*.

Transfer roller 11*a* is applied with a high voltage of a polarity (+) opposite to the polarity (−) of the static charge on the toner, for transferring the multi-color toner image formed on the intermediate transfer belt 7 to the recording sheet.

Further, either transfer roller 11*a* or transfer belt drive roller 8-1 is formed of a hard material (metal or the like) while the other roller is formed of an elastic roller of a metal core covered with a soft material (elastic rubber roller, foamed resin roller or the like) With this configuration, it is possible to constantly produce a predetermined nip.

A registration roller 14 is arranged under transfer belt drive roller 8-1 and transfer station 11. This registration roller 14 is configured so as to convey the recording sheet that is fed from paper feed portion 109, toward the transfer station 11 side by aligning the front end of the sheet with the leading end of the toner image on intermediate transfer belt 7.

Since, as mentioned above, the toner adhering to intermediate transfer belt 7 as the belt comes in contact with photoreceptor drums 3, or the toner which has not been transferred to the recording sheet by intermediate transfer roller 6 and remains on intermediate transfer belt 7, would cause color contamination of toners at the next operation, transfer belt cleaning unit 9 is adapted to remove and collect such toner.

As shown in FIG. 3, transfer belt cleaning unit 9 is arranged adjacent to transfer belt driven roller 8-2, and includes: a cleaning blade 9*a* arranged so as to abut (come into sliding contact with) intermediate transfer belt 7; and a box-like toner collector 9*b* for temporarily holding the waste toner, left over on and scraped from intermediate transfer belt 7 by the cleaning blade 9*a*, to thereby scrape and collect the leftover toner off the intermediate transfer belt 7 surface. The thus collected waste toner is conveyed to a waste toner collecting container.

Also, transfer belt cleaning unit 9 is arranged near process printing unit 20*d*, on the upstream side of the process printing unit 20*d* with respect to the moving direction of intermediate transfer belt 7. Further, intermediate transfer belt 7 is supported from its interior side by transfer belt driven roller 8-2, at the portion where cleaning blade 9*a* comes into contact with the outer surface of intermediate transfer belt 7.

Fixing unit 12 includes: as shown in FIG. 1, a pair of fixing rollers 12*a* consisting of a heat roller 31 and pressing roller 32; and a conveying roller 25-5 above the fixing rollers 12*a* and is constructed such that the recording sheet is input from below fixing rollers 12*a* and output upward.

Above fixing unit 12 a paper discharge roller 25-6 is arranged next to conveying roller 25-5 so that the recording sheet conveyed from conveying roller 25-5 is discharged by the paper discharge roller 25-6 onto paper output tray 15.

Referring to the fixing of a toner image by fixing unit 12, a heating device (not shown) such as a heater lamp or the like, provided inside or close to heat roller 31 is controlled based on the measurement from a temperature detector (not shown) so as to keep heat roller 31 at a predetermined temperature (fixing temperature) while the recording sheet with a toner image transferred thereon is heated and pressed between heat roller 31 and pressing roller 32 as it is being conveyed and rolled thereby, so that the toner image is thermally fused onto the recording sheet.

Paper feed portion 109 includes a multiple number of paper feed trays 10 for holding recording paper to be used for image forming, and is adapted to deliver recording paper, sheet by sheet, from paper feed tray 10 to image forming portion 108.

Paper feed trays 10 are arranged under the image forming portion 108 and exposure unit 50 in housing 1*a*, so as to accommodate a large amount of recording sheets of a size specified by the apparatus specification or of a size that is determined beforehand by the user.

Arranged above one end side (the left-hand side in the drawing) of each paper feed tray 10 is a pickup roller 16, which touches one end part of the surface of the topmost sheet of the recording sheets set on the paper feed tray 10 and reliably picks up and feeds the paper, sheet by sheet, by the function of roller's frictional resistance.

Paper output tray 15 is arranged on the top of image forming apparatus 1 so that printed recording sheets can be discharged and stacked facedown.

Also, in paper feed portion 109 a paper feed path S that extends approximately vertically to convey recording sheets in paper feed trays 10 to paper output tray 15 located above by way of transfer station 11 and fixing unit 12.

Arranged along the paper feed path S from paper feed trays 10 to paper output tray 15 are pickup rollers 16, registration roller 14, transfer station 11, fixing unit 12, conveying rollers 25 (25-1 to 25-8) for conveying recording sheets, and others.

Registration roller 14 functions to time the right moment of next conveyance by halting the recording sheet conveyed along paper feed path S and deliver the recording sheet to transfer station 11 at such a timing that the leading edge of the toner image on intermediate transfer belt 7 coincides with the front end of the image recording area on the recording sheet.

The recording sheet fed from paper feed tray 10 is conveyed by means of conveying rollers 25-1 to 25-4 in the feed path up to registration roller 14 and temporarily stopped thereby. Then, the stopped recording sheet is started to be conveyed toward transfer station 11 by registration roller 14 at such a timing as to make the front end of the image recording area on the recording sheet register with the leading edge of the toner image on intermediate transfer belt 7.

The recording sheet being conveyed is passed through transfer station 11 where the toner image on intermediate transfer belt 7 is transferred thereto, then is further conveyed through fixing unit 12 where the unfixed toner on the recording paper is thermally fused and fixed to the recording sheet. After passage of fixing unit 12, the fused toner is cooled by itself and sticks to the recording sheet. Then, the recording sheet is discharged onto paper output tray 15 by way of conveying rollers 25-5 and 25-6.

Here, the recording sheet with a multi-color image fixed thereon is conveyed to the inverse discharge path in paper feed path S and is discharged by conveying rollers 25-5 and 25-6 and placed facedown (with the multi-color toner image down) on paper output tray 15.

Arranged under paper output tray 15 is a control board 40.

Control board 40 includes a microcomputer for controlling the operations of individual components in image forming apparatus 1; ROM for storing control programs to be executed by the microcomputer; and RAM for providing the work area for the processing of the microcomputer and the storage area of image data.

The microcomputer executes the control programs to function as a controller. This controller's function realizes the aforementioned image forming, toner image transfer, recording sheet conveyance, temperature control in the fixing unit and the like.

Control board 40 also includes input and output circuits. The input circuit receives signals from the sensors arranged at diverse components in image forming apparatus 1 so that the microcomputer is able to effect processing using the input signals. The output circuit is a circuit that outputs signals for driving the loads arranged at various parts.

Next, the distinctive transfer belt unit mounting and dismounting mechanism for mounting and dismounting transfer belt unit 8 according to the present embodiment will be described in detail with reference to the drawings.

Figure 4:
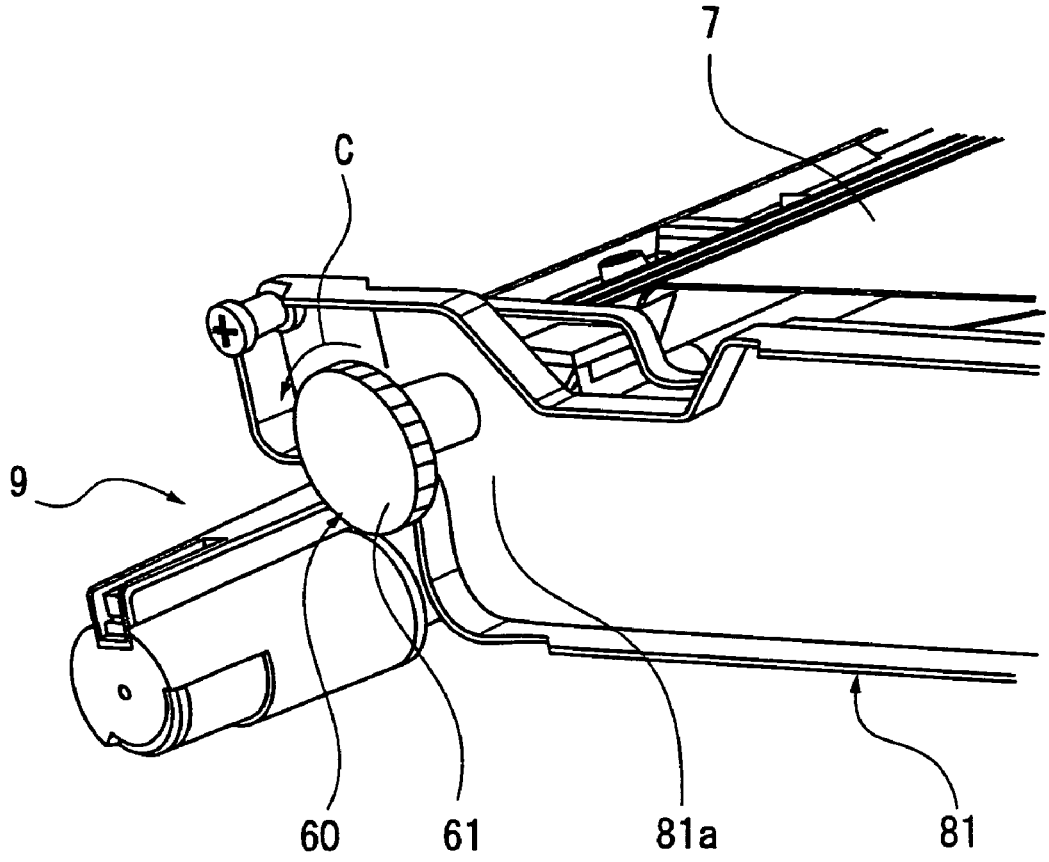
FIG. 4 is an illustrative view showing a configuration of a coupling/decoupling manipulator that couples the transfer belt unit and the apparatus body.
Figure 5:
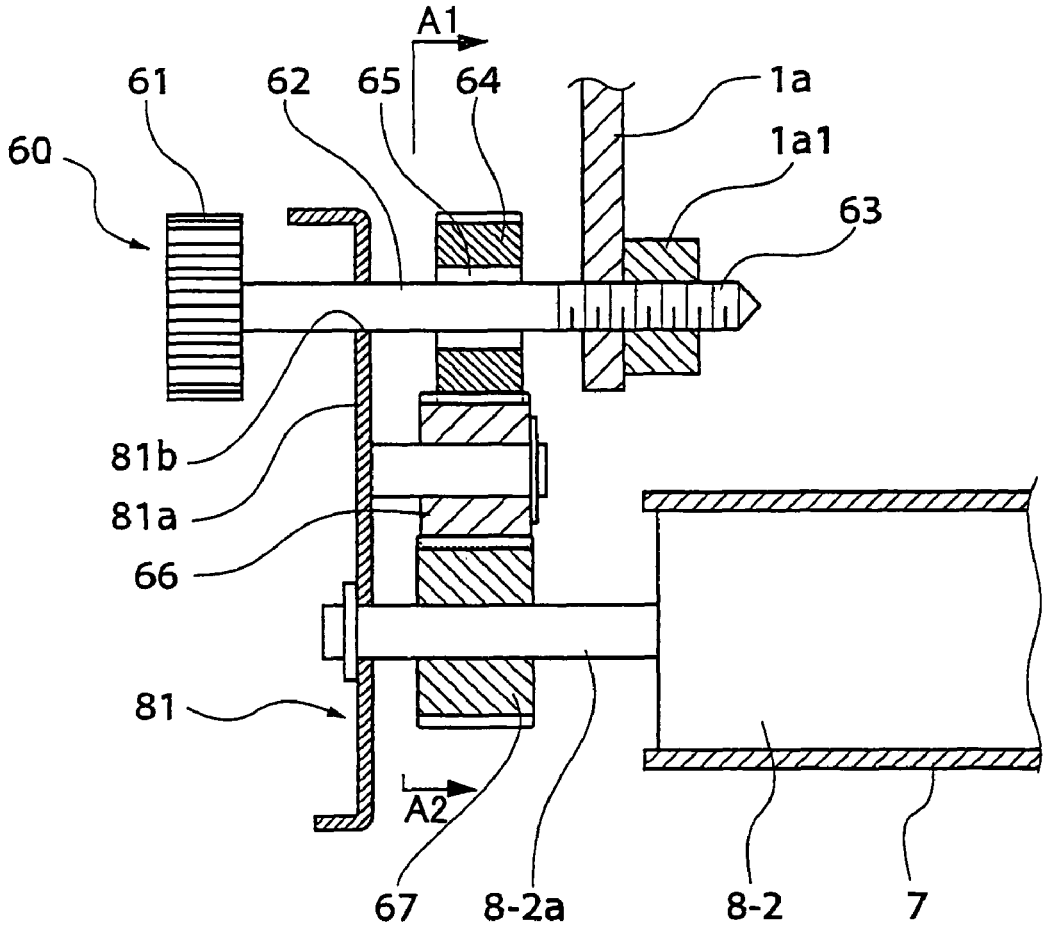
FIG. 5 is a partial sectional view showing the configuration of the coupling/decoupling manipulator.
Figure 6:
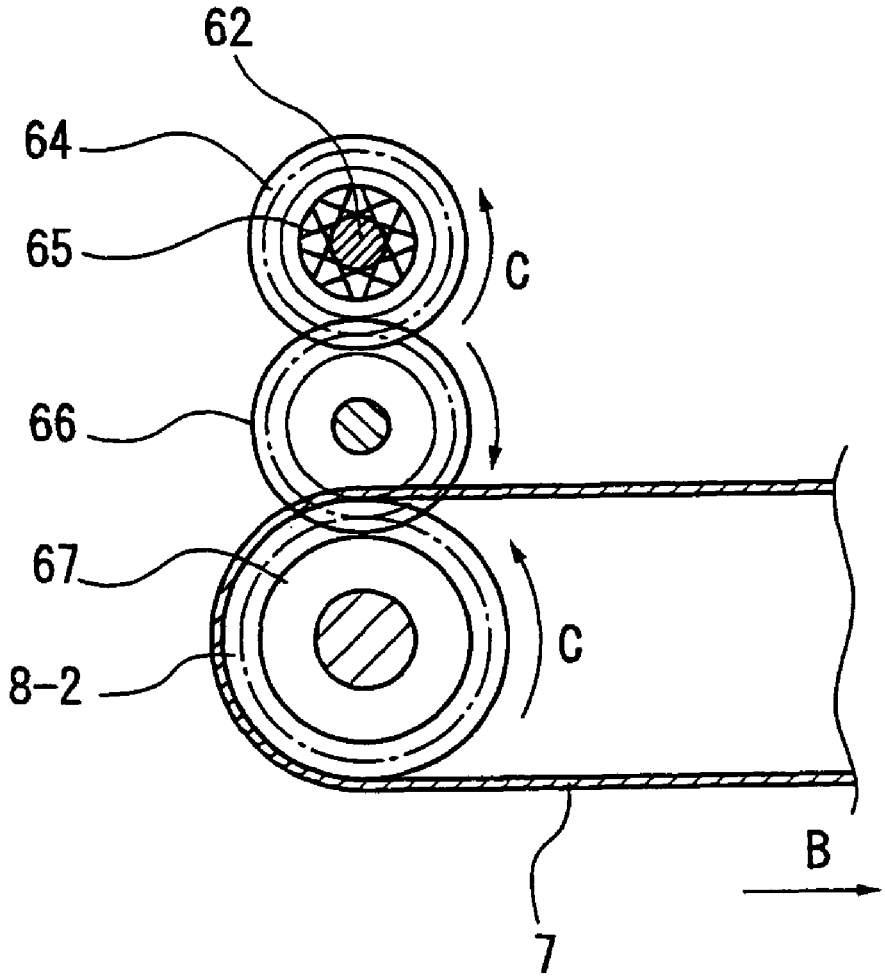
FIG. 6 is a sectional view of FIG. 5 cut along a plane A1-A2.

FIG. 4 is a perspective view showing a coupling/decoupling manipulator that couples the transfer belt unit and the apparatus body in accordance with the present embodiment; FIG. 5 is a partial sectional view showing the configuration of the coupling/decoupling manipulator; and FIG. 6 is a sectional view of FIG. 5 cut along a plane A1-A2.

The transfer belt unit mounting and dismounting mechanism according to the present embodiment is to mount and dismount transfer belt unit 8 relative to the apparatus body of image forming apparatus 1, and includes, as shown in FIGS. 2, 4 and 5, a coupling/decoupling manipulator 60 for coupling and decoupling between transfer belt unit 8 and housing 1*a* at a coupling portion 81*a* with housing 1*a* of the apparatus body in a unit frame 81 of transfer belt unit 8.

As shown in FIGS. 4 and 5, coupling/decoupling manipulator 60 is arranged close to transfer belt driven roller 8-2 in coupling portion 81*a* that is arranged on the transfer belt cleaning unit 9 side in unit frame 81. Coupling/decoupling manipulator 60 includes a knob 61, a bolt 62, a threaded portion 63 and a drive gear (gear element) 64, as shown in FIG. 5. Knob 61 is a handle for performing manual operation. Shaft 62 is provided integrally with knob 61. Threaded portion 63 is formed in the front end part of bolt 62 to fix unit frame 81 of transfer belt unit 8 and housing 1*a* by screw fastening. Drive gear (gear element) 64 is arranged concentrically with bolt 62 to transfer the rotational force of bolt 62.

Formed in housing 1*a* at the position corresponding to coupling portion 81*a* is an attachment boss 1*a*1 having a threaded hole that will fit around threaded portion 63. An attachment hole 81*b* into which bolt 62 is inserted is formed in coupling portion 81*a* of unit frame 81.

Knob 61 has a disk-like form with its peripheral side formed with a series of ridges, i.e., a knurled pattern, and is arranged projectively from the unit frame 81 surface. This knob 61 is manually operated by the user gripping it.

Bolt 62 is rotatably fitted into attachment hole 81*b* formed in unit frame 81. This arrangement enables bolt 62 to position unit frame 81 relative to housing 1*a* by screw fastening threaded portion 63 to housing 1*a*.

Here, concerning the positioning between unit frame 81 and housing 1*a*, it goes without saying that another positioning member for positioning unit frame 81 at a predetermined position of housing 1*a* may be provided separately.

Though in the present embodiment, bolt 62 is directly fitted in unit frame 81, but the bolt may be attached rotatably by using a sliding bearing (e.g., a bush member with self-lubrication such as a metal bush impregnated with oil) or the like.

Threaded portion 63 is formed so that the screwing action is limited when it has been screwed into attachment boss 1*a*1 by a predetermined amount (by predetermined rotation). For example, the outside diameter of bolt 62 is formed to be greater than the outside diameter of threaded portion 63 so that the end (the proximal part of threaded portion 63) of bolt 62 abuts the attachment surface of housing 1*a* to perform a stopper function when threaded portion 63 is screwed into housing l*a* by a predetermined distance.

Driver gear 64 is disposed between unit frame 81 and housing 1. This drive gear 64 has a one-way clutch 65 built therein concentrically therewith and is engaged with bolt 62 via one-way clutch 65.

One-way clutch 65 is arranged with its outer side integrally fixed to driver gear 64 and its inner side engaged with bolt 62 so that it locks and integrally couples bolt 62 with drive gear 64 when bolt 62 rotates in a specified direction.

One-way clutch 65 is arranged so that bolt 62 can rotate relative to drive gear 64 when bolt 62 is rotated in such a direction that threaded portion 63 screws into housing 1*a* (in the mounting direction) and so that drive gear 64 is integrally coupled with bolt 62 and rotates together with bolt 62 when bolt 62 is rotated in such a direction that threaded portion 63 is loosed from housing 1*a* (in the dismounting direction). In other words, when bolt 62 rotates in the direction in which the coupling between transfer belt unit 8 and housing 1*a* is released, the rotational force of bolt 62 is transmitted to drive gear 64.

A driven gear 67 which receives drive from drive gear 64 is provided on a shaft 8-2*a* of transfer belt driven roller 8-2 and fixed integrally with transfer belt driven roller 8-2. This driven gear 67 receives drive from drive gear 64 via an idle gear 66 arranged between itself and drive gear 64. This arrangement makes drive gear 64 and driven gear 67 rotate in the same direction.

In the present embodiment, as coupling/decoupling manipulator 60 is rotated in the direction of arrow C (in the counterclockwise direction) as shown in FIG. 6, driven gear 67 rotates in the same direction, i.e., in the direction of arrow C, via idle gear 64, so that intermediate transfer belt 7 is conveyed in the forward direction of conveyance (in the direction of arrow B).

In this arrangement, one-way clutch 65 is engaged so that drive gear 64 rotates as bolt 62 rotates in the direction of arrow C. Threaded portion 63 on bolt 62 of knob 61 is formed so that its screw fitting becomes loose from house housing 1*a* when it rotates counterclockwise (in the direction of arrow C) in FIG. 6 while its screw fitting becomes tight as it rotates clockwise. That is, as threaded portion 63 is rotated in the loosening direction from housing 1*a*, drive gear 64 rotates so as to convey intermediate transfer belt 7 in the forward direction of conveyance (in the direction of arrow B).

On the other hand, when intermediate transfer belt 7 is driven in the forward direction of conveyance (in the direction arrow B), driven gear 67 rotates in the direction of arrow C and hence rotates drive gear 64 in the direction of arrow C via idle gear 66. This rotation of drive gear 64 in the direction of arrow C corresponds to the rotation of bolt 62 in the direction opposite to the direction of arrow C from a viewpoint of one-way clutch 65, or corresponds to the case where the drive force in the aforementioned mounting direction is applied. As a result, rotation of drive gear 64 is cut off by one-way clutch 65 so that no drive is transmitted to bolt 62. This means that no conveyance of intermediate transfer belt 7 in the forward direction of conveyance (in the direction of arrow B) will be transferred to bolt 62, so that there is no risk of the screw fastened state of threaded portion 63 being loosened.

In the present embodiment, the number of thread ridges on threaded portion 63 is designated so as to meet the number of rotation of the driven gear 67 (the number of rotation of driven roller 8-2) that is required to convey intermediate transfer belt 7 by the distance from the position of the toner image that has been printed just before the releasing operation by the coupling/decoupling manipulator 60 is started or at the start of the releasing operation (when a paper jam occurs during transfer, for example), to the position where the toner image passes through transfer belt cleaning unit 9. For example, the number of thread ridges on threaded portion 63 can be designated to meet the number of times driven gear 67 (i.e., driven roller 8-2) needs to be rotated to cause intermediate transfer belt 7 at the position of intermediate transfer roller 6*d* on the most upstream side to pass through transfer belt cleaning unit 9.

Further, in the present embodiment, the outside diameter of knob 61 is specified so that the rotational torque for moving intermediate transfer belt 7 by the rotating action of coupling/decoupling manipulator 60 is equal to 0.9807 N·m or below. This specification is to enable convey intermediate transfer belt 7 to be easily conveyed when knob 61 is operated by the operator or others. However, the characteristic operational effect of the present invention is not be marred if the torque is greater than the above value.

Next, dismounting operation of transfer belt unit 8 by the transfer unit mounting and dismounting mechanism according to the present embodiment will be described.

When transfer belt unit 8 is dismounted from image forming apparatus 1, as shown in FIGS. 4 and 5 knob 61 of coupling/decoupling manipulator 60 is rotated counterclockwise in the drawing so that threaded portion 63 at the front end part is unscrewed from housing 1*a* on the apparatus body side to thereby release the coupled condition between unit frame 81 of transfer belt unit 8 and housing 1*a* of the apparatus body.

As knob 61 is rotated counterclockwise, bolt 62 that is connected to knob 61 rotates and one-way clutch 65 engages bolt 62 so that drive gear 64 rotates counterclockwise. As a result, idle gear 66 meshing with drive gear 64 rotates clockwise and driven gear 67 meshing with idle gear 66 rotates counterclockwise so as to cause driven roller 8-2 to convey intermediate transfer belt 7 in the forward direction of conveyance or in the direction of arrow B.

As intermediate transfer belt 7 is conveyed forward, the part of the transfer belt 7 surface that is located upstream of transfer belt cleaning unit 9 with respect to the belt conveying direction is cleaned. That is, the part of the transfer belt 7 surface ranging the distance that is conveyed by rotating coupling/decoupling manipulator 60 by the predetermined angle of rotation can be cleaned.

In the present embodiment, the distance by which intermediate transfer belt 7 is conveyed by coupling/decoupling manipulator 60 is set to be the distance from the position of the toner image that has been printed just before the releasing operation by the coupling/decoupling manipulator 60 is started or at the start of the releasing operation, for example when a paper jam occurs during transfer, to the position where the toner image passes through transfer belt cleaning unit 9. Accordingly, as shown in FIG. 3, it is possible by transfer belt cleaning unit 9 to remove the toner image remnant that remains on transfer belt 7 located on the upper side of transfer belt unit 8 after passage of transfer station 11 and/or the untransferred toner image on transfer belt 7 located on the lower side of transfer belt unit 8 before passage of transfer station 11.

In this way, the toner image remnant and toner image on transfer belt 7 can be removed when the coupled condition between transfer belt unit 8 and the apparatus body has been completely released by coupling/decoupling manipulator 60.

Accordingly, if transfer belt 7 becomes exposed when transfer belt unit 8 is drawn out from the apparatus body, only the part of transfer belt 7 that has been cleaned up without any trace of output image left shows up in transfer belt unit 8, hence it is possible to give security against leakage of information. Further, since neither the toner image remnant nor the toner image exists on transfer belt 7, it is possible to prevent the toner from dirtying the apparatus interior when transfer belt unit 8 is mounted and dismounted.

Next, when transfer belt unit 8 is mounted to image forming apparatus 1, transfer belt unit 8 is set into place inside the apparatus and knob 61 of coupling/decoupling manipulator 60 is rotated clockwise so that threaded portion 63 at the front end part is screw-fastened into housing 1*a* on the apparatus body side.

When knob 61 is rotated clockwise, bolt 62 that is connected to knob 61 to rotate alone whereas drive gear 64 does not receive any rotational drive because one-way clutch 65 cuts off its engagement with bolt 62. As a result, driven gear 67 is unrotated without performing any conveyance of transfer belt 7 while threaded portion 63 at the front end can be screwed into the apparatus body side, completing the coupling operation.

According to the present invention, since the mounting and dismounting operations are performed as described above, provision of coupling/decoupling manipulator 60 for the transfer belt unit mounting and dismounting mechanism and just a rotation of knob 61 in coupling/decoupling manipulator 60 upon dismounting of transfer belt unit 8 from the apparatus body, make it possible to take out transfer belt unit 8 from the apparatus body after the transfer belt 7 surface where a toner image or toner image remnant has been formed is moved away. As a result, only the part of transfer belt 7 that has been cleaned up without any trace of output image left shows up on transfer belt unit 8, hence it is possible to keep security against leakage of information.

Further, since neither the toner image remnant nor the toner image exists on transfer belt 7, it is possible to prevent the toner from dirtying the apparatus interior when transfer belt unit 8 is mounted and dismounted.

Additionally, in the present embodiment the surface of transfer belt 7 is adapted to be cleaned by transfer belt cleaning unit 9 while transfer belt 7 is being moved. However, the present invention should not be limited to this. For example, transfer belt 7 is simply moved so as to bring the area of transfer belt 7 on which no toner image or toner image remnant exists to the upper position of transfer belt unit 8 where it attracts operator's direct attention.

With this configuration, it is possible to avoid exposure of the toner image or toner image remnant formed on transfer belt 7 to other people, hence achieve improvement in security.

Further, according to the present embodiment, intermediate transfer belt 7 is adapted to be conveyed by coupling and decoupling manipulator 60 by the distance ranging from the position of the toner image that has been printed just before the releasing operation by the coupling/decoupling manipulator 60 is started or at the start of the releasing operation, to the position where the toner image passes through transfer belt cleaning unit 9. However, the present invention should be limited to this. It is possible to set up the amount of conveyance of the transfer belt in any way in order not to allow other people to see the toner image or toner image remnant formed on transfer belt 7, depending on the image forming apparatus configuration.

Moreover, though in the present embodiment, coupling/decoupling manipulator 60 is operated manually by operator and others, the present invention is not limited to the way it is operated. For example, it is possible to develop a configuration by providing a driver for driving the coupling/decoupling manipulator as a part of the intermediate transfer unit mounting and dismounting mechanism so that the coupling/decoupling manipulator can be automatically operated when intermediate transfer unit is mounted and dismounted.

Also, the present invention should be not limited to the image forming apparatus having the configuration described above as long as it is an image forming apparatus using an intermediate transfer system with toner, and can be applied to other types of image forming apparatuses. For example, in the present embodiment, process printing units 20 are arranged under intermediate transfer unit 8, but the image forming apparatus of the present invention should be limited to this apparatus layout, and they may be arranged over intermediate transfer unit 8.

As has been described, the present invention is not limited to the above embodiment and examples, and various modifications can be made within the range specified in the scope of claims. That is, any embodied mode obtained by combination of technical means modified as appropriate without departing from the spirit and scope of the present invention should be included in the technical art of the present invention.

What is claimed is:

1. An intermediate transfer unit mounting and dismounting mechanism for use in an image forming apparatus, the image forming apparatus comprising:

an image forming portion having a photoreceptor drum on which a toner image is formed;

an intermediate transfer element to which the toner image formed on the photoreceptor drum is temporarily transferred;

a transfer device for transferring the toner image from the intermediate transfer element to a recording medium;

a cleaning portion for removing the toner that has not been transferred from the intermediate transfer element to the recording medium by the transfer device and remains on the intermediate transfer element; and an intermediate transfer unit, at least including the intermediate transfer element and a driver for driving the intermediate transfer element as an integrated configuration separated from the apparatus body, and being constructed to be mountable to and dismountable from the apparatus body, the intermediate transfer unit mounting and dismounting mechanism including:

a coupling/decoupling manipulator disposed at the coupling portion between the intermediate transfer unit and the apparatus body for coupling/decoupling the intermediate transfer unit and the apparatus body, the coupling/decoupling manipulator including: a threaded portion for coupling the intermediate transfer unit and the apparatus body by screw fastening and a gear element for transferring driving force for conveying the intermediate transfer element, and providing the function of screw-fastening the intermediate transfer unit and the apparatus body by rotating the threaded portion in a predetermined direction and the function of disengaging the fastened condition between the intermediate transfer unit and the apparatus body by rotating the threaded portion in the direction opposite to the predetermined direction and conveying the intermediate transfer element as the gear element rotates in linkage with the rotation of the threaded portion.

2. The intermediate transfer unit mounting and dismounting mechanism according to claim 1, wherein when the coupling/decoupling manipulator is rotated in a direction that releases the fastened condition between the intermediate transfer unit and the apparatus body, the intermediate transfer element is conveyed in the forward direction.

3. The intermediate transfer unit mounting and dismounting mechanism according to claim 1, wherein the threaded portion has the function of positioning the intermediate transfer unit relative to the apparatus body.

4. The intermediate transfer unit mounting and dismounting mechanism according to claim 1, wherein the coupling/decoupling manipulator is disposed on the cleaning portion side.

5. The intermediate transfer unit mounting and dismounting mechanism according to claim 1, wherein the gear element is arranged in the coupling/decoupling manipulator with a one-way clutch therebetween, and the one-way clutch is arranged so as to transfer drive power when the coupling/decoupling manipulator is rotated in a direction that releases the coupling between the intermediate transfer unit and the apparatus body.

6. The intermediate transfer unit mounting and dismounting mechanism according to claim 1, wherein the intermediate transfer element is formed of an endless belt member.

7. The intermediate transfer unit mounting and dismounting mechanism according to claim 6, wherein the coupling/decoupling manipulator is set up so as to be rotatable with a rotational torque of 0.9807 N·m or below when the intermediate transfer element is moved.

8. The intermediate transfer unit mounting and dismounting mechanism according to claim 6, wherein the intermediate transfer element is formed of chloroprene rubber.

9. The intermediate transfer unit mounting and dismounting mechanism according to claim 7 wherein the intermediate transfer element is formed of chloroprene rubber.

10. The intermediate transfer unit mounting and dismounting mechanism according to claim 1, wherein the coupling/decoupling manipulator operates such that while the threaded portion disengages the coupled condition between the intermediate transfer unit and the apparatus body, the gear element conveys the intermediate transfer element from the position where a releasing operation of the toner image printed just before the releasing operation is started by the coupling/decoupling manipulator, to the position where the toner image passes through the cleaning portion.

11. An intermediate transfer unit mounting and dismounting method for use in an image forming apparatus that includes:

an image forming portion having a photoreceptor drum on which a toner image is formed;

an intermediate transfer element to which the toner image formed on the photoreceptor drum is temporarily transferred;

a transfer device for transferring the toner image from the intermediate transfer element to a recording medium;

a cleaning portion for removing the toner that has not been transferred from the intermediate transfer element to the recording medium by the transfer device and remains on the intermediate transfer element; and an intermediate transfer unit, at least including the intermediate transfer element and a driver for driving the intermediate transfer element as an integrated configuration separated from the apparatus body, and being constructed to be mountable to and dismountable from the apparatus body, the method comprising the steps of:

screw-fastening the intermediate transfer unit and the apparatus body by rotating a coupling/decoupling manipulator that is disposed at the coupling portion between the intermediate transfer unit and the apparatus body in a predetermined direction of rotation when the fastened condition between the intermediate transfer unit and the apparatus body is engaged; and, releasing the fastened condition between the intermediate transfer unit and the apparatus body by rotating the coupling/decoupling manipulator in the direction opposite to the predetermined direction of rotation and conveying the intermediate transfer element when the fastened condition between the intermediate transfer unit and the apparatus body is to be disengaged.

* * * * *